US006810941B2

(12) United States Patent
Tsuchiya et al.

(10) Patent No.: US 6,810,941 B2
(45) Date of Patent: Nov. 2, 2004

(54) INJECTION MOLD FOR SEMI-SOLIDIFIED FE ALLOY

(75) Inventors: Masayuki Tsuchiya, Kawachi-Gun (JP); Hiroaki Ueno, Kawaguchi (JP); Isamu Takagi, Utsunomiya (JP); Naokuni Muramatsu, Nagoya (JP); Masato Yasuda, Nishikasugai-Gun (JP)

(73) Assignees: NGK Insulators, Ltd., Nagoya (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/158,580

(22) Filed: May 30, 2002

(65) Prior Publication Data

US 2003/0024682 A1 Feb. 6, 2003

(30) Foreign Application Priority Data

Jun. 1, 2001 (JP) ..... 2001-166283

(51) Int. Cl.[7] ..... B22C 3/00
(52) U.S. Cl. ..... 164/312; 164/138
(58) Field of Search ..... 164/72, 138, 312, 164/113

(56) References Cited

U.S. PATENT DOCUMENTS

| | | | | | |
|---|---|---|---|---|---|
| 4,687,042 | A | * | 8/1987 | Young | 164/80 |
| 5,575,325 | A | * | 11/1996 | Sugiura et al. | 164/120 |
| 5,638,889 | A | * | 6/1997 | Sugiura et al. | 164/319 |
| 5,730,201 | A | * | 3/1998 | Rollin et al. | 164/113 |
| 5,799,717 | A | | 9/1998 | Aoshima et al. | |
| 5,803,154 | A | * | 9/1998 | Sugawara et al. | 164/120 |
| 6,136,101 | A | * | 10/2000 | Sugawara et al. | 148/321 |

FOREIGN PATENT DOCUMENTS

| | | |
|---|---|---|
| DE | 199 33 026 A1 | 1/2001 |
| EP | 0 774 525 A1 | 5/1997 |
| EP | 0 718 059 B1 | 7/1998 |
| GB | 2 345 699 | 7/2000 |
| JP | 62-207534 | 9/1987 |
| JP | 06-269936 | 9/1994 |
| JP | 6-269936 | 9/1994 |
| JP | 6-269939 | 9/1994 |
| JP | 06-269939 | 9/1994 |
| JP | 7-204820 | 8/1995 |
| JP | 8-174147 | 7/1996 |
| JP | 9-108776 | 4/1997 |
| JP | 2000-144304 | 5/2000 |

* cited by examiner

*Primary Examiner*—Kuang Y. Lin
(74) *Attorney, Agent, or Firm*—Burr & Brown

(57) ABSTRACT

An injection mold for casting a semi-solidified Fe alloy includes a scalping gate for eliminating surface oxide film of a semi-solidified Fe alloy injected into the mold cavity from a pressure chamber. The scalping gate is arranged between the pressure chamber and a runner that is in communication with the mold cavity. The mold halves and the scalping gate are each formed of a copper alloy having a thermal conductivity of not less than 120 W/(m·K) and a hardness of not less than 180 HB. The mold halves and the scalping gate each have a cermet layer consisting essentially of at least one member selected from a group consisting of Co, Cu, Cr and Ni. The cermet layer is formed by electro-spark deposition, via an intermediate layer of Ni alloy, which is also formed by electro-spark deposition.

7 Claims, 3 Drawing Sheets

INJECTION MOLD FOR SEMI-SOLIDIFIED FE ALLOY

This application claims the benefit of Japanese Application 2001-166,283, filed Jun. 1, 2001, the entirety of which is incorporated herein by reference.

BACKGROUND OF THE INVENTION

1. Field of the Invention

The present invention relates to an injection mold for casting semi-solidified Fe alloy that is in a solid-liquid coexistence state.

2. Description of Related Art

It is known to cast semi-solidified metal into a product by injection-molding method, such as rheocasting method or thixocasting method, wherein the semi-solidified metal is pressurized and injected into the mold cavity. Such injection-molding method proved to be highly advantageous in that, in contrast to conventional die-casting methods, the mold is subjected only to a relatively low level of thermal shock due to requirement for less preheating of the mold, besides lower casting temperature as well as less dissipation of solidification latent heat. For these grounds, the injection-molding method is generally regarded as a promising technology for casting metals with a relatively high melting point, e.g., Cu alloy and Fe alloy, which had been generally considered not very suitable for die-casting, primarily from economical viewpoint associated with a relatively short service life of the mold.

One may consider that the injection mold for semi-solidified metal can be formed of hard iron or steel material, such as hot die steel SKD61 (JIS G4404, ASTM H13), as in a die-cast mold for casting aluminum or the like light metal. As generally known in the art, however, iron or steel materials inclusive of SKD61 have a poor thermal conductivity of typically 40 W/(m·K) or less. Thus, when such materials are applied to an injection mold for casting metal, beside insufficient cooling capacity for the cast products or relatively long preheating time required for the mold, the following problems are likely to occur.

A) During gradual cooling and solidification of semi-solidified metal in the mold cavity, slurry tends to enter into clearances between knockout pins and surrounding holes, both provided for the mold, thereby forming undesirable flashes on the outer surface of the cast product, which must be removed to realize satisfactory product quality.

B) Plastic strains are accumulated in the mold due to large temperature gradient in the mold and repeated action of tensile and compressive stresses at the mold surface, and tend to cause premature crack formation in the mold. Moreover, severe stress concentration occurs at convex surface portions of the mold cavity having a small radius of curvature, so that hair cracks tend to be formed in the mold surface to shorten the life of the mold.

C) In the case of semi-solidified Fe alloy which comprises hypo-eutectic cast iron, for example, the poor cooling capacity of the mold leads to coarse graphite structure after annealing. In other words, it is difficult to obtain the desired fine graphite structure and sufficient mechanical strength of the cast products.

D) Upon injection of semi-solidified Fe alloy into the mold cavity, oxide film forming the outer surface of the alloy tends to enter into the mold cavity, thereby degrading the product quality.

SUMMARY OF THE INVENTION

It is therefore a primary object of the present invention to provide an improved injection mold for casting semi-solidified Fe alloy, which effectively eliminates the above-mentioned problems of the prior art.

It is more specific object of the present invention to provide an improved injection mold for casting semi-solidified Fe alloy, having excellent thermal conductivity and mechanical strength, and capable of effectively preventing entry of surface oxide film of the semi-solidified Fe alloy into the mold cavity.

The inventors conducted thorough research and investigations seeking a practical solution of the above-mentioned problems, and attained the following recognition.

First of all, copper alloys had been generally considered to be unsuitable as casting molds for high temperature materials, because copper alloy has strength inferior to iron or steel materials, despite higher thermal conductivity. Nevertheless, the inventors found that, since semi-solidified metal allows lower temperature of slurry upon injection molding, copper alloys having appropriately controlled composition to provide a sufficient hardness are still durable enough even when used as the material for the casting molds.

The inventors also found it effective to provide a scalping gate adjacent to the runner in communication with the mold cavity, and designed the scalping gate to have an opening diameter slightly smaller than that of the pressure chamber, so as to positively eliminate a surface oxide film of the semi-solidified Fe alloy as it is pressurized in the chamber and injected into the mold cavity.

Based on such recognition, an injection mold including a scalping gate was prepared from a copper alloy having a controlled composition, which had been adjusted to provide sufficient thermal conductivity and mechanical strength, to conduct trial injection molding of semi-solidified Fe alloy. As a result, it was found that considerable wear occurs at convex surface portions of the mold having a small radius of curvature near the opening of the scalping gate and within the mold cavity, indicating that the mold and the scalping gate require further improvement in terms of their durability for practical use.

The inventors then applied a cermet coating onto those surface portions of the mold and scalping gate, which are susceptible to wear, and conducted trial injection molding of semi-solidified Fe alloy. In this connection, the cermet coating was applied essentially as taught by U.S. Pat. No. 5,799,717, the disclosure of which is herein incorporated by reference. However, even by applying a cermet coating to the copper alloy base materials, it was found that the cermet coating tends to be peeled off during the actual injection molding, making it still difficult to achieve the desired durability of the mold and scalping gate.

The inventors analyzed the cause of the undesired peeling of the cermet coating and found that relatively acute convex portions of the mold and scalping gate are subjected to unexpectedly high thermal shock due to relatively high temperature of the semi-solidified Fe alloys as compared to Al or Al alloys to which U.S. Pat. No. 5,799,717 is directed, besides inclusion of solid components in the semi-solidified Fe alloys.

The inventors then thoroughly conducted experiments and investigations on measures effectively allowing formation of a stable cermet coating that can be maintained in firm adhesion to the base material and exhibiting excellent durability against high thermal shock upon injection molding of semi-solidified Fe alloy, to thereby provide an improved injection mold suitable for practical injection-molding of the semi-solidified Fe alloy. The present invention is based on a novel recognition that the stability of the cermet coating and, hence, the durability of the injection mold can be advantageously improved by applying a pre-coating of Ni alloy as an intermediate layer, before applying a cermet coating on the base material.

According to the present invention, there is provided an injection mold for semi-solidified Fe alloy, comprising a pair of mold members defining a mold cavity, and a scalping gate for removing a surface oxide film of the semi-solidified Fe alloy as it is pressurized in a pressure chamber in one of the mold members and injected into the mold cavity, the scalping gate being arranged between the pressure chamber and a runner in the other of the mold members, the runner being in communication with the mold cavity, the mold members and scalping gate each having a surface contacted by said semi-solidified Fe alloy during casting thereof:

The mold members and the scalping gate each comprise a copper alloy having a thermal conductivity of not less than 120 W/(m·K) and a hardness of not less than 180 HB, and the mold members and the scalping gate each comprise a cermet layer consisting essentially of at least one member selected from a group consisting of Co, Cu, Cr and Ni. The cermet layer is formed by electro-spark deposition at least partially on the surface, via a Ni alloy intermediate layer which is also formed by electro-spark deposition.

It is additionally or alternatively preferred that the Ni alloy forming the intermediate layer has a composition consisting essentially of 30 to 50 mass %, in total, of at least one member selected from a group consisting of Cr, Fe, Mo and W, and the balance consisting of Ni and inevitable impurities.

It is additionally or alternatively preferred that the Ni alloy forming the intermediate layer has a film thickness within a range of 5 to 100 $\mu$m, and an arithmetic mean surface roughness Ra within a range of 5 to 50 $\mu$m.

It is additionally or alternatively preferred that the copper alloy has a composition consisting essentially of:

Ni: 1.0 to 2.0 mass %,

Co: 0.1 to 0.6 mass %,

Be: 0.1 to 0.3 mass %,

Mg: 0.2 to 0.7 mass %, and

Cu and inevitable impurities: the balance.

It is additionally or alternatively preferred that the cermet layer comprises one of WC—Co cermet, $MoB_2$—Ni cermet and $Cr_3C_2$—Ni cermet.

It is additionally or alternatively preferred that the cermet layer has arithmetic mean surface roughness Ra within a range of 5 to 100 $\mu$m.

It is additionally or alternatively preferred that the scalping gate comprises a coolant passage therein.

BRIEF DESCRIPTION OF THE DRAWINGS

The present invention will be further explained below with reference to a preferred embodiment shown in the accompanying drawings.

DETAILED DESCRIPTION OF THE INVENTION

Figure 1:
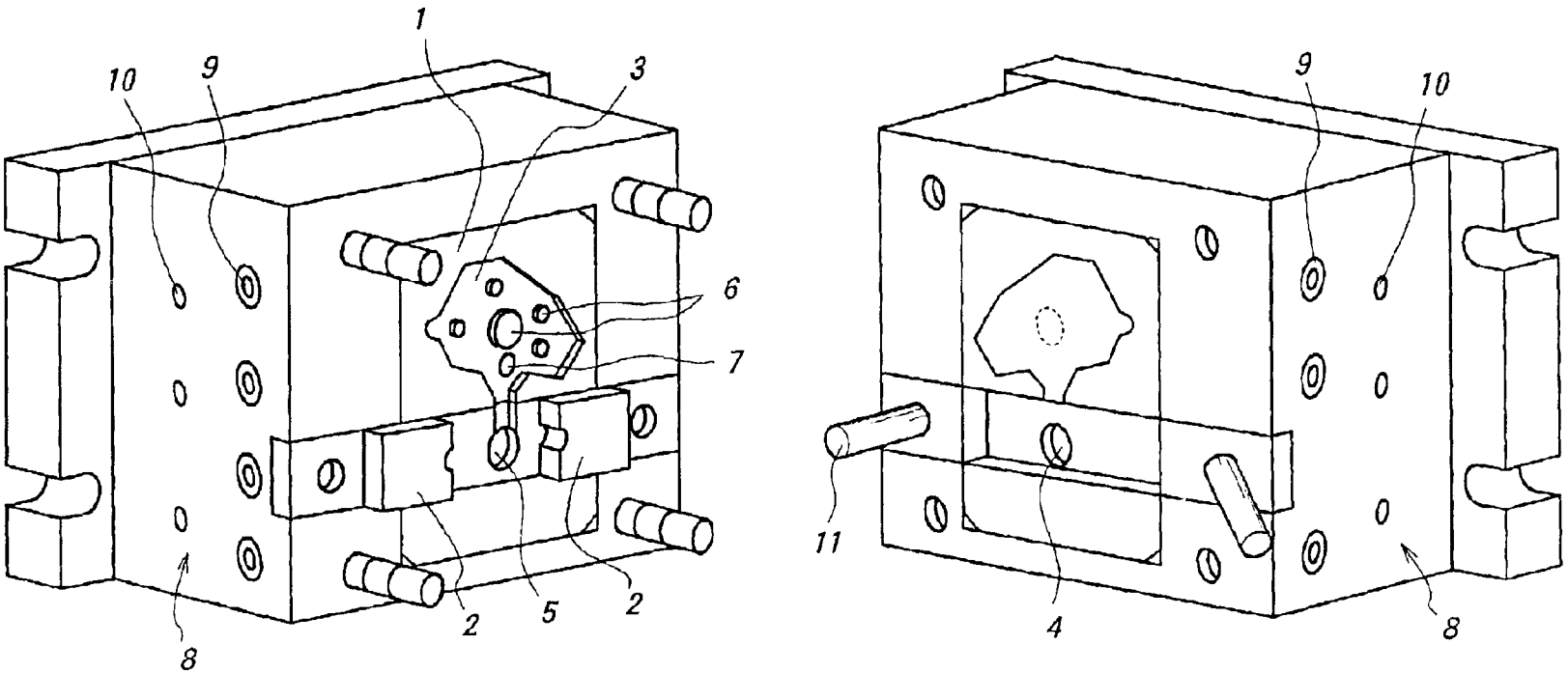
FIG. 1 is a perspective view of a casting mold according to the present invention.

FIG. 1 is a perspective view of an injection mold 1 according to one embodiment of the present invention, for injection-molding semi-solidified Fe alloy that is in a solid-liquid coexistence state, which is made of a copper alloy to be more fully described hereinafter. The injection mold 1 comprises a pair of mold members, which are in abutment with each other along a parting surface PS when the mold 1 is closed. The injection mold 1 is provided with a scalping gate 2 for preventing entry of surface oxide film of the semi-solidified Fe alloy as it is pressurized and injected into a mold cavity 3 that is defined between the mold members. The scalping gate 2 comprises a pair of gate members, which are made of the same copper alloy as the mold members. The gate members can be moved toward each other as the mold 1 is closed, and away from each other as the mold 1 is opened, as indicated by double arrows in FIG. 2(*c*). One of the mold members has a pressure chamber 4 in which the semi-solidified Fe alloy is charged. The pressure chamber 4 is associated with a plunger to pressurize the semi-solidified Fe alloy so that it is injected into the mold cavity 3 via the scalping gate 2 and a runner having an entrance that is denoted by reference numeral 5. The mold cavity 3 is provided with projections 6 corresponding to depressions in the cast product, and an ejector pin 7 for removing the cast product out of the mold cavity 3.

The mold members are accommodated within respective frame members 8. Each frame member 8 is formed with passages 9 for passing heat medium therethrough when the injection mold is to be preheated before the injection molding, and passages 10 for passing coolant therethrough when the injection mold is to be cooled after the injection molding. One of the frame members 8 is provided with inclined slide pins 11 that are engaged with back surfaces of the gate members to open or close the scalping gate 2 as the mold members are opened or closed. The injection mold 1 has a structure that is generally the same as that according to UK Patent Application GB 2345699A or co-pending U.S. patent application Ser. No. 09/508,458, the disclosures of which are herein incorporated by reference.

According to the present invention, the copper alloy forming the mold 1 and scalping gate 2 has a thermal conductivity of not less than 120 W/(m·K), and a Brinell hardness of not less than 180 HB, in consideration of the required cooling rate and mechanical strength against thermal stresses. Copper alloy with a thermal conductivity less than 120 W/(m·K) does not provide a sufficient cooling rate, making it difficult to eliminate the problems of the prior art explained above. Moreover, copper alloy with a Brinell hardness less than 180 HB tends to cause deformation and/or cracks of the mold due to thermal shock, even when cermet coating is applied to the surface of the copper alloy. It is noted, in a general sense, that high thermal conductivity and high Brinell hardness are desirable. However, an excessive thermal conductivity results in degraded weldability, thereby making it difficult to repair the mold, while an excessive Brinell hardness results in increased number of machining steps upon manufacturing the mold. Thus, it is preferred that the upper limit values of the thermal conductivity and Brinell hardness are approximately 300 W/(m·K) and 300 HB, respectively.

According to the present invention, the scalping gate 2 arranged adjacent to the entrance of the runner 5 has an opening diameter slightly smaller than that of the pressure chamber 4. Such scalping gate 2 serves to eliminate surface oxide film of the semi-solidified Fe when it is injected into the mold cavity 3, thereby effectively preventing introduction of the surface oxide film into the cavity 3. It is preferred that the opening diameter of the scalping gate 2 is approximately 15 to 80% of that of the pressure chamber 4.

According to the present invention, a cermet coating is applied, via an intermediate layer comprised of Ni alloy, at least partly onto the inner surface of the mold 1, the surface of the scalping gate 2 and the inner surface of the pressure chamber 4. As mentioned above, wear and/or cracks tend to occur by thermal shocks, near convex surfaces within the mold cavity 3 having a small radius of curvature R, and near the opening of the scalping gate 2. Thus, insofar as the above-mentioned surface regions are concerned, it is highly effective to apply a cermet coating via the intermediate layer of Ni-based alloy, since the cermet coating exhibits a low affinity to the semi-solidified Fe alloy and has an excellent heat resistance.

It is highly important to form intermediate layer of Ni alloy as an, before application of the cermet coating. It is noted that Ni alloy can be readily molten and bonded to the copper alloy when it is applied onto copper alloy, since the totality of Ni and Cu mutually dissolve in themselves. Further, Ni has a thermal expansion coefficient that is between those of Cu and cermet, so that the Ni alloy serves to mitigate difference in expansion or shrinkage between the copper alloy mold and the cermet layer, due to temperature change during continuous casting. Particularly, coating the intermediate layer including 50 mass % or more of Ni largely increases the coating efficiency to the copper alloy as a base material. Further, the Ni-based alloy is also readily melted and bonded to a metal binder component of the cermet layer (e.g., Co in the case of WC—Co cermet), and thus plays an important role as the intermediate layer for mediating between the cermet layer and the copper alloy as the base material when applying the cermet layer onto the base material. It is preferred that the Ni alloy has a composition consisting of 30 to 50 mass % in total of at least one member selected from a group consisting of Cr, Fe, Mo and W, and the balance consisting of Ni and inevitable impurities.

It is further preferred that the intermediate layer comprised of Ni alloy has a thickness on the order of 5 to 100 $\mu$m, and surface roughness of on the order of 5 to 50 $\mu$m in terms of arithmetic mean value (Ra). The thickness of the intermediate layer less than 5 $\mu$m results in ineffective bonding layer between the cermet layer and the base material (copper alloy), while the thickness exceeding 100 $\mu$m leads to excessively thick intermediate layer so as to deteriorate heat conduction from the surface to the base material. Further, the surface roughness of the intermediate layer less than 5 $\mu$m does not achieve a sufficient surface area upon forming a diffusion layer between the cermet layer and the intermediate layer, and/or desired piling effect by virtue of form-locking connection between the concave and convex shapes. On the other hand, the surface roughness exceeding 50 $\mu$m are desirable to increase the surface area and achieve the piling effect, though the resultant unevenness of the intermediate may become excessive thereby decreasing its adhesion area with the cermet layer.

It is preferred that the cermet layer is comprised of combination of (A) at least one of (i) carbide ceramics, such as WC, TiC, $Mo_2C$, ZrC, NbC, VC, TaC, (ii) nitride ceramics, such as TiN, ZrN, $Cr_2N$, (iii) silicide ceramics, such as $TiSi_2$, $ZrSi_2$, (iv) boride ceramics, such as $TiB_2$, $ZrB_2$, $NbB_2$, MoB, WB, and (v) oxide ceramics, such as $Al_2O_3$, $TiO_2$, $ZrO_2$, and $Cr_2O_3$; and (B) at least one of Co, Cu, Cr and Ni. It is particularly preferred that the cermet layer is comprised of WC—Co, $MoB_2$—Ni or $Cr_3C_2$—Ni.

It is further preferred that the cermet layer has a thickness on the order of 10 through 50 $\mu$m, and a surface roughness on the order of 5 to 100 $\mu$m, more preferably 10 to 50 $\mu$m, in terms of arithmetic mean value (Ra). Formation of the cermet layer having the above-mentioned thickness and surface roughness effectively mitigate stress concentration at convex surface regions having a small radius of curvature within the mold cavity corresponding to the product shape, and in the vicinity of the opening of the scalping gate, thereby effectively suppressing occurrence of wear or hair cracks, for example.

It is preferred that the intermediate layer and the cermet layer are formed by electro-spark deposition process, such as that disclosed in JP 06-269936A and/or JP 06-269939A, the disclosures of which are herein incorporated by reference. Electro-spark deposition process is particularly advantageous for various reasons, e.g., (i) it allows formation of a strong diffusion layer by melting, unlike plating or the like, (ii) it is free from limitations in terms of size of the mold, (iii) it can be applied as a partial coating as well, (iv) it is free from dead points or shadow positions in which coating is impossible as in thermal spraying process or the like, and (v) it readily permits adjustment of both the thickness and surface roughness of the coating. Moreover, since electro-spark deposition can be carried out under normal temperature conditions with minimized heat input, it is possible effectively to avoid softening of copper alloy, which would be caused by exposure to higher temperature for a long time.

Figure 2:
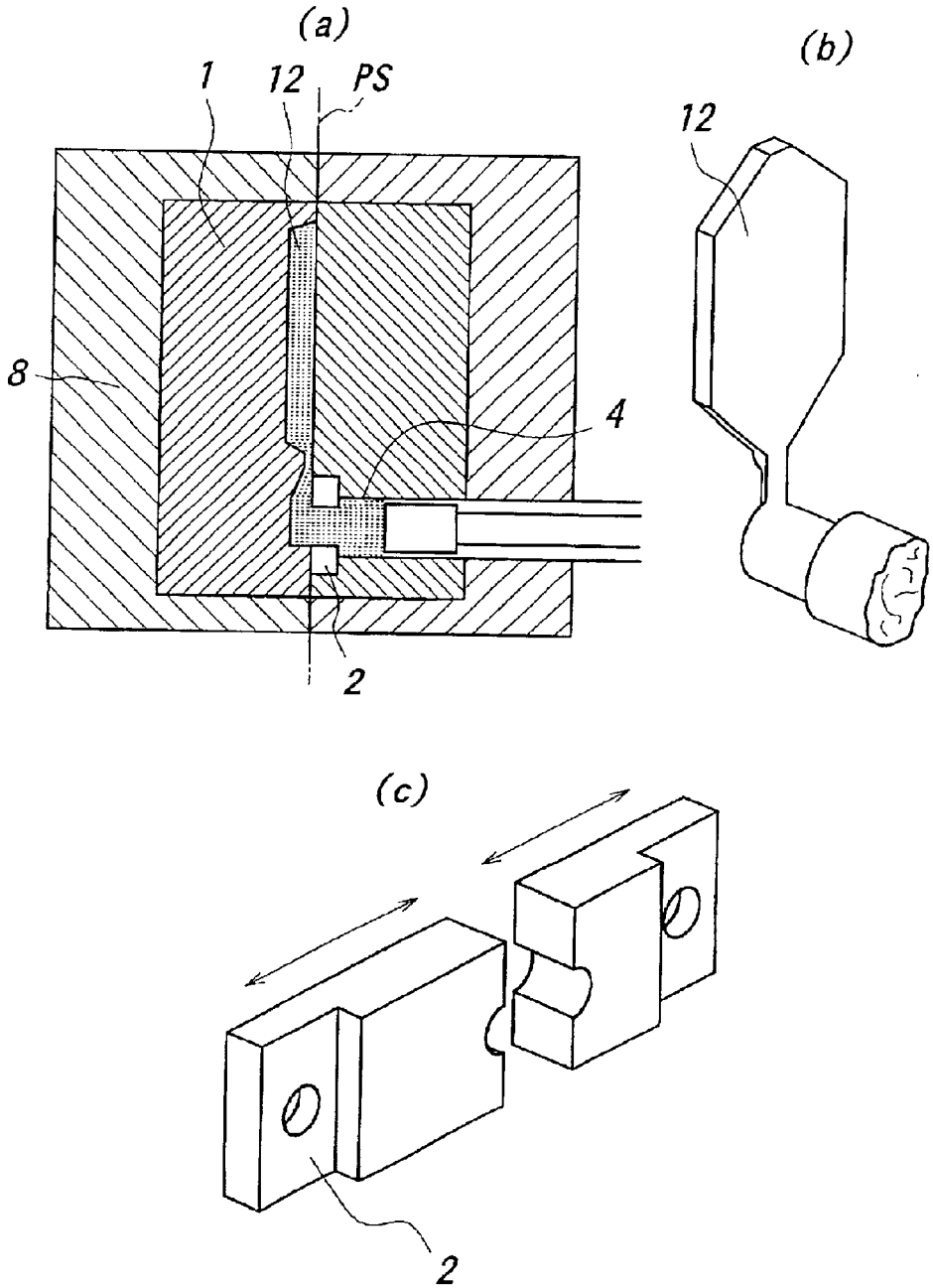
FIGS. 2(*a*), 2(*b*) and 2(*c*) show the injection molding of a semi-solidified Fe alloy injected into the mold from a horizontal direction.
Figure 3:
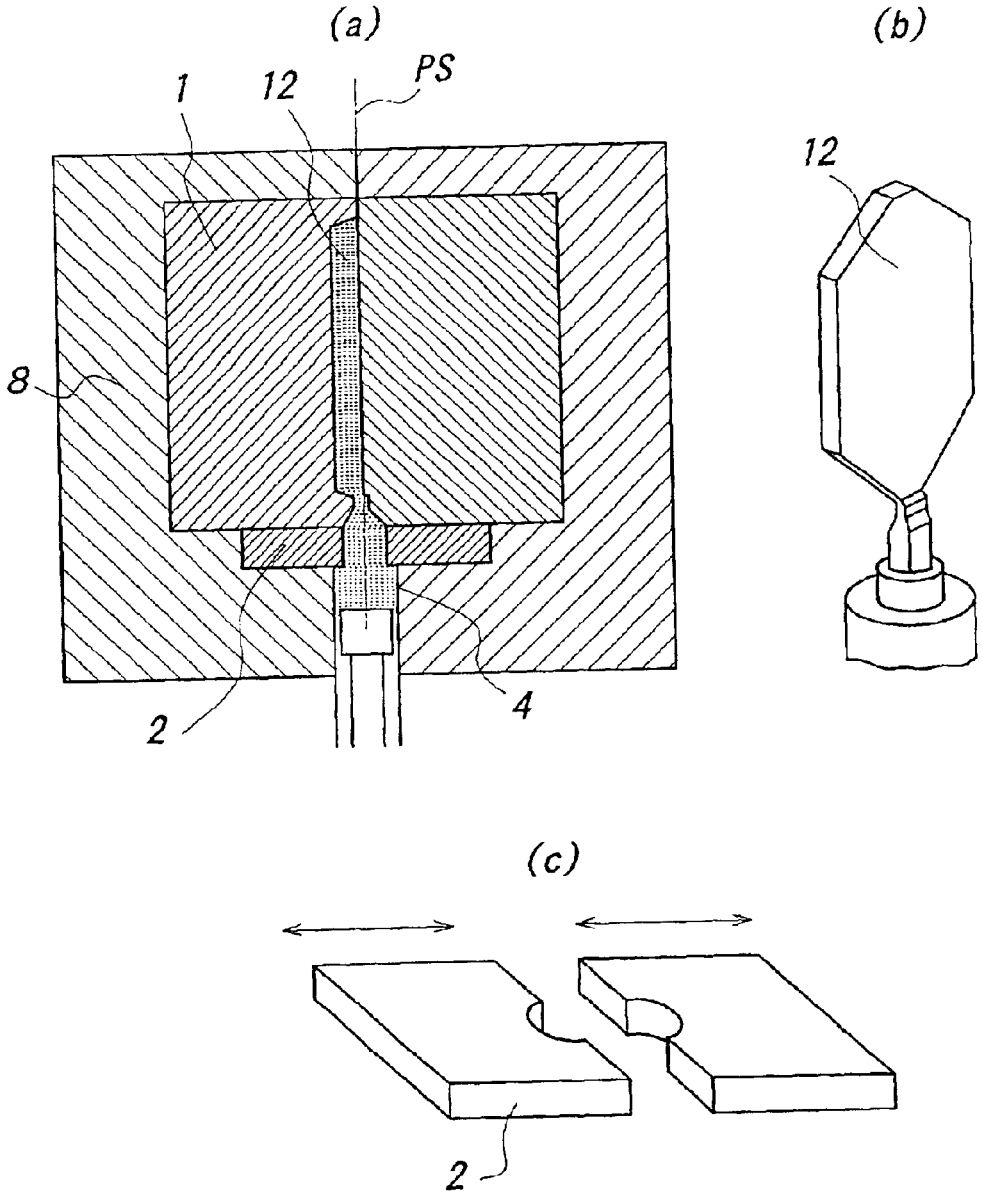
FIGS. 3(*a*), 3(*b*) and 3(*c*) show injection molding of semi-solidified Fe alloy injected into the mold from a vertical direction.

The injection mold may be designed so that the semi-solidified Fe alloy injected into the mold from horizontal direction, as shown in FIG. 1 and FIGS. 2(*a*) to 2(*c*), or from vertical direction as shown in FIGS. 3(*a*) to 3(*c*). In either case, the scalping gate 2 having a diameter slightly smaller than that of the pressure chamber 4 is arranged adjacent to runner 5 communicating with the mold cavity 3, so as to allow formation of robust cast products 12 that are free of mixed surface oxide film.

For positively eliminating the surface oxide film of the semi-solidified Fe alloy by the scalping gate 2, it is preferred that the scalping gate 2 has cooling system therein. Further, since the mold 1 and the scalping gate 2 are formed of the same material according to the present invention, it is possible to avoid various problems, such as inferior fitting between the mold 1 and the scalping gate 2 under elevated temperature, which would be caused if they were formed of materials with different thermal expansions, or complicated and strict gap management of the mold 1 and the scalping gate 2 to avoid such inferior fitting.

The present invention is applicable to casting of semi-solidified Fe alloy, which mainly refers to Fe—C based alloy such as hypo-eutectic cast iron, without limited thereto. For example, the semi-solidified Fe alloy may comprise other alloys including so-called soft iron resembling pure iron, and even low alloy steel and high-alloy steel, provided that a solid-liquid coexistence state can be readily formed without noticeable difficulties.

Furthermore, it is preferred that the copper alloy as the material of the mold and scalping gate preferably has a composition consisting of:

Ni: 1.0 to 2.0 mass %,

Co: 0.1 to 0.6 mass %,

Be: 0.1 to 0.3 mass %,

Mg: 0.2 to 0.7 mass %, and

Cu and inevitable impurities: the balance.

Such composition provides advantageous characteristics in terms of thermal conductivity of 120 to 230 W/(m·K) and hardness of 180 to 300 HB. The significance of the numerical limitation relating to the composition of such copper alloy will be explained below.

Ni: 1.0 to 2.0 Mass %:

Ni is added to improve the strength by virtue of formation of NiBe compound. Ni contents less than 1.0 mass % results in insufficient improvement in strength, while Ni contents exceeding 2.0 mass % results in saturation in terms of the strength improving effect, in addition to relatively poor thermal conductivity.

Co: 0.1 to 0.6 Mass %:

Co is added to improve the strength by virtue of formation of CoBe compound. Co contents less than 01 mass % results in insufficient improvement in strength, while Co contents exceeding 0.6 mass % results in increased brittleness to deteriorate the hot workability.

Be: 0.1 to 0.3 Mass %:

Be bonds to Ni and Co to thereby form NiBe compound and CoBe compound, thereby contributing to improvement of strength. However, Be contents less than 0.1 mass % results in insufficient improvement in strength, while Be contents exceeding 0.3 mass % results in relatively poor thermal conductivity.

Mg: 0.2 to 0.7 Mass %:

Mg is added to improve the ductility at higher temperatures. Mg contents less than 0.2 mass % results in insufficient ductility improving effect, while Mg contents exceeding 0.7 mass % results not only in deteriorated ductility improving effect, but also in relatively poor thermal conductivity.

[Embodiment]

The mold having the structure shown in FIG. 1 was used to conduct injection molding of a semi-solidified Fe alloy. The semi-solidified Fe alloy as the injection material was hypo-eutectic cast iron including Fe-2.5%C-2.0% Si as its main component, and having a solidus rate of 55% at 1,200° C. The mold and the scalping gate were each formed of copper alloys, chromium-copper, and SKD61, as shown in Table 1. The entire inner surface of the mold, the surface of the scalping gate and the inner surface of the injection opening were applied with Ni alloy layer as an intermediate layer, and also with the cermet layer, as shown in Table 1. The opening diameter of the scalping gate is 30 mmϕ, which corresponds to 55% of the diameter 55 mmϕ of the pressure chamber.

Table 2 shows the test result after injection molding under the above conditions, with respect to damaged degree near the scalping gate opening, occurrence of cracks at convex R portions within the mold cavity, mixing degree of surface oxides into the cast product, occurrence of flashes, and preheating time of the mold. The targeted number of shots was 100 to 120. Table 2 also shows the test result of cast iron obtained by the injection molding under the above conditions followed by annealing, with respect to the degree of graphite fineness, tensile strength and elongation. The tensile strength and elongation are represented by arithmetic mean values of the measured values for cast products that are free of mixed oxides, respectively.

The preheating time corresponds to a required period of time from preheat starting of the injection mold up to the ready for casting state, and the convex R crack signifies occurrence of hair cracks at corner R portions that project into the mold cavity. The evaluation criteria of the respective items are as follows. Fineness is evaluated based on microscopic structure observation, by circles "O" for sufficiently achieved graphite fineness, and by crosses "x" for insufficient graphite fineness exhibiting coarse graphite structure. Tensile strength is evaluated by conducting tension test in conformity to JIS. Flash formation is evaluated after casting based on occurrence slurry insertion into gaps between ejecting pins and corresponding pin holes, as well as between the scalping gate and the mold. Oxide mixture is visually evaluated by appearance and fracture analysis concerning inferior quality due to entrainment of surface oxide films upon solidification into the surface or interior of the cast product. Overall evaluation is indicated by double circles "◎" for excellent improvement, by circles "O" for acceptable improvement, and by crosses "x" for unacceptable improvement.

TABLE 1

[Targeted number of shots for evaluation: 100 to 200 shots]

| | Mold Material | | | Intermediate Layer | | | Cerment Layer | | | | Water |
|---|---|---|---|---|---|---|---|---|---|---|---|
| No. | Chemical composition (mass %) | Thermal conductivity (W/(m · K)) | Hardness HB | Composition (mass %) | Thickness (μm) | Surface roughness Ra (μm) | Type | Thickness (μm) | Surface roughness Ra (μm) | Material of scalp gate | cooling of scalp gate |
| 1 | Cu-1.5Ni-0.5Co-0.25Be-0.5Mg | 218 | 209 | Ni-25Cr-20Fe | about 50 | 15 | WC-Co | about 30 | 12 | Same copper alloy with mold | Yes |
| 2 | Cu-1.5Ni-0.5Co-0.25Be-0.5Mg | " | " | Ni-35Cr-24Fe | about 30 | " | WC-Co | about 20 | " | Same copper alloy with mold | " |
| 3 | Cu-1.5Ni-0.5Co-0.25Be-0.5Mg | " | " | Ni-25Cr-20Fe | about 50 | " | WC-Co | about 30 | " | Same copper alloy with mold | No |
| 4 | Cu-1.5Ni-0.5Co-0.25Be-0.5Mg | " | " | " | " | " | WC-Co | about 30 | " | No scalp gate | — |
| 5 | Cu-1.5Ni-0.5Co-0.25Be-0.5Mg | " | " | None | — | — | WC-Co | about 18 | 15 | Same copper alloy with mold | Yes |
| 6 | Cu-0.9Ni-0.3Co-0.1Be-0.1Mg | 290 | 170 | Ni-25Cr-20Fe | about 30 | 15 | WC-Co | about 20 | 12 | Same copper alloy with mold | " |
| 7 | Cu-7.0Ni-0.7Co-0.2Be-0.5Mg | 108 | 189 | " | about 50 | " | WC-Co | about 30 | " | Same copper alloy with mold | " |
| 8 | Cu—Cr—Zr (chromium-copper with Zr) | 330 | 115 | None | — | — | None | — | — | Chromium-copper | " |
| 9 | SKD61 (Hot die steel) | 27 | 370 | None | — | — | None | — | — | SKD61 | " |

TABLE 2

| No. | | Number of shots | Damage degree of gate opening | Cracks at mold convex R portion | Mixed number of oxides | Flash formation | Pre-heating time (min) | Degree of graphite fineness | TS ($N/mm^2$) | Elongation (%) | Overall evaluation | Remarks |
|---|---|---|---|---|---|---|---|---|---|---|---|---|
| 1 | Invention Example | 115 | Good | None | 0 | None | 20 | ○ | 460 | 15 | ◎ | |
| 2 | Invention Example | 118 | Good | None | 0 | None | " | ○ | 466 | 16 | ◎ | (A) |
| 3 | Invention Example | 105 | Slightly damaged | None | 7 | None | " | ○ | 452 | 15 | ○ | |
| 4 | Comparative Example | 119 | — | None | 103 | None | " | ○ | 453 | 15 | x | |
| 5 | Comparative Example | 35 | Cermet layer separation | None | 0 | None | " | ○ | 465 | 14 | x | (B) |
| 6 | Comparative Example | 80 | Damaged | Occurred | 0 | None | 18 | ○ | 458 | 14 | x | (C) 80 shots |
| 7 | Comparative Example | 88 | " | Occurred | 23 | Occurred | 34 | x | 320 | 5 | x | (C) 88 shots |
| 8 | Comparative Example | 63 | " | Occurred | 2 | None | 15 | ○ | 453 | 14 | x | (C) 63 shots |
| 9 | Comparative Example | 55 | Largely damaged | Occurred | 18 | Occurred | 54 | x | 292 | 5 | x | (C) 55 shots |

Remarks: (A) Coating execution time is 1.3 times of No. 1.
(B) Cerment layer separation at 35 shots.
(C) Crack occurred: and stopped at noted shots.

As shown in Table 2, each of Sample Nos. 1 through 3 adopting the mold according to the present invention makes it possible to obtain cast iron product having excellent quality with sufficiently achieved graphite fineness, without convex R portion cracks, and substantially free from oxide mixtures. In contrast, Sample No. 4 without the scalping gate does not eliminate oxide mixtures, thereby failing to obtain excellent result. In case of Sample No. 5 without Ni alloy intermediate layer, it was necessary to stop casting only at 35 shots, due to separation of the cermet layer from the surface of the mold and/or scalping gate. Sample No. 6 has a low hardness of the copper alloy for the mold, thereby leading to inferior mechanical strength, and it was thus necessary to stop casting at 80 shots. Sample No. 7 has a low thermal conductivity of the copper alloy for the mold such that graphite fineness is not suitably progressed, and it was thus necessary to stop casting at 88 shots due to formation of flashes. In case of Sample No. 8, the chromium-copper alloy used as the mold material has a high thermal conductivity with low hardness, thereby making it difficult or impossible to apply the intermediate layer and/or cermet layer, together with insufficient hardness, so that it was necessary to stop casting at 63 shots. In Sample No. 9 adopting conventional SKD61 material as the mold, the graphite fineness is not progressed, flash formation occurred and the preheating time is long, and it was necessary to stop the casting at 55 shots.

The copper alloy mold according to the present invention has sufficient thermal conductivity and mechanical strength as the mold for injection-molding semi-solidified Fe alloy; has sufficient durability to severe thermal shock upon injection-molding of the semi-solidified Fe alloy; and is capable of effectively avoiding mixture of surface oxide films of the semi-solidified Fe alloy into the mold cavity; thereby stably realizing high quality products.

While the present invention has been described above with reference to a specific embodiment shown in the accompanying drawings, it has been presented for an illustrative purpose only, and various changes or modifications may be made without departing from the scope of the invention as defined by the appended claims.

What is claimed is:

1. An injection mold for semi-solidified Fe alloy, comprising a pair of mold members defining a mold cavity, and a scalping gate for removing a surface oxide film of a semi-solidified Fe alloy as the semi-solidified Fe alloy is pressurized in a pressure chamber in one of said mold members and injected into the mold cavity, said scalping gate being arranged between said pressure clamber and a runner provided in the other of said mold member, said runner being in communication with said mold cavity, said mold members and said scalping gate each having a surface that is contacted by said semi-solidified Fe alloy during casting thereof;

said mold members and said scalping gate each comprising a copper alloy having a thermal conductivity of not less than 120 W/(m·K) and a hardness of not less than 180 HB; and said mold members and said scalping gate each comprising a cermet layer consisting essentially of at least one member selected from the group consisting of Co, Cu, Cr and Ni, said cermet layer being formed by electro-spark deposition at least partially on said surface, that is contacted by the semi-solidified Fe alloy, via a Ni alloy intermediate layer, said Ni alloy intermediate layer having a film thickness in a range of 5–100 $\mu$m and an arithmetic mean surface roughness Ra within a range of 5–50 $\mu$m, said Ni alloy intermediate layer being formed by electro-spark deposition.

2. The injection mold according to claim 1, wherein said Ni alloy of said intermediate layer consists essentially of 30 to 50 mass %, in total, of at least one member selected from the group consisting of Cr, Fe, Mo and W, and the balance consisting of Ni and inevitable impurities.

3. The injection mold according to claim 1, wherein said copper alloy of said mold members and said scalping gate consists essentially of:

Ni: 1.0 to 2.0 mass %;

Co: 0.1 to 0.6 mass %;

Be: 0.1 to 0.3 mass %;

Mg: 0.2 to 0.7 mass %; and wherein Cu and inevitable impurities comprise the balance.

4. The injection mold according to claim 1, wherein said cermet layer comprises one of WC—Co cermet, $MoB_2$—Ni cermet and $Cr_3C_2$—Ni cermet.

5. The injection mold according to claim 1, wherein said cermet layer has arithmetic mean surface roughness Ra within a range of 5 to 100 $\mu$m.

6. The injection mold according to claim 1, wherein said scalping gate further comprises a coolant passage provided therein.

7. The injection mold according to claim 1, wherein said cermet layer has a thickness in a range of 10 to 50 $\mu$m.

* * * * *

UNITED STATES PATENT AND TRADEMARK OFFICE

CERTIFICATE OF CORRECTION

PATENT NO. : 6,810,941 B2
DATED : November 2, 2004
INVENTOR(S) : Masayuki Tsuchiya et al.

It is certified that error appears in the above-identified patent and that said Letters Patent is hereby corrected as shown below:

Title page,
Item [56], References Cited, FOREIGN PATENT DOCUMENTS, delete "JP 06-269936 9/1994" and; delete "JP 06-269939 9/1994"

Column 10,
Line 38, add -- casting a -- after "for"
Line 40, change the third occurrence of "a" to -- the --
Line 43, change "the" to -- said --
Line 44, change "clamber" to -- chamber --
Line 45, change "member" to -- members --
Line 48, change "said" to -- the --

Column 12,
Line 5, add -- an -- after "has"

Signed and Sealed this

First Day of February, 2005

JON W. DUDAS
*Director of the United States Patent and Trademark Office*